US006470646B1

(12) United States Patent
Bryant

(10) Patent No.: US 6,470,646 B1
(45) Date of Patent: Oct. 29, 2002

(54) ROOF SCAFFOLDING SYSTEM

(76) Inventor: Lyle W. Bryant, 602 N. Kennedy, Ellinwood, KS (US) 67526

( * ) Notice: Subject to any disclaimer, the term of this patent is extended or adjusted under 35 U.S.C. 154(b) by 0 days.

(21) Appl. No.: 09/840,940

(22) Filed: Apr. 24, 2001

(51) Int. Cl.[7] ..... E04D 15/02; E04D 15/04

(52) U.S. Cl. ..... 52/749.12; 52/747.1; 52/741.1; 33/188; 33/648; 182/45; 182/206; 248/244

(58) Field of Search ..... 52/749.1, 749.12, 52/747.1; 182/45, 120, 129, 206, 214, 117; 240/235, 244; 33/648, 187, 188

(56) References Cited

U.S. PATENT DOCUMENTS

| | | | | | |
|---|---|---|---|---|---|
| 232,556 | A | | 9/1880 | Silvius | |
| 718,602 | A | | 7/1903 | Chase | |
| 859,241 | A | | 7/1907 | Nantel | |
| 1,586,421 | A | | 5/1926 | Frush | |
| 2,426,825 | A | | 9/1947 | Geary | 304/20 |
| 3,526,296 | A | | 9/1970 | Stevens | 182/45 |
| 3,842,934 | A | * | 10/1974 | Bartlett | 182/37 |
| 4,056,889 | A | * | 11/1977 | Barnett, III | 33/188 |
| 4,068,446 | A | * | 1/1978 | Brueske | 52/747 |
| 4,132,287 | A | * | 1/1979 | Parolini | 182/45 |
| 4,183,144 | A | * | 1/1980 | Barnett, III | 33/188 |
| 4,785,606 | A | | 11/1988 | Burton | 52/749 |
| 5,197,257 | A | * | 3/1993 | Nietling | 52/749 |
| 5,318,148 | A | | 6/1994 | Franco et al. | 182/45 |
| 5,601,154 | A | * | 2/1997 | Eisemenger | 182/45 |
| 5,624,006 | A | | 4/1997 | Richardson, Jr. | 182/45 |
| 5,908,083 | A | * | 6/1999 | Hamilton | 182/45 |
| 6,003,629 | A | | 12/1999 | Cloutier et al. | 182/45 |
| 6,220,390 | B1 | * | 4/2001 | Pike | 182/45 |

* cited by examiner

*Primary Examiner*—Yvonne M. Horton
(74) *Attorney, Agent, or Firm*—Flanagan & Flanagan; John R. Flanagan

(57) ABSTRACT

A roof scaffolding system includes a support assembly disposed on one inclined surface of a roof extending to a peak of the roof and attached to an opposite inclined surface of the roof near the peak thereof, a roof jack resting on the one inclined surface of the roof astraddle and connected to the support assembly, a valley support assembly disposed on a valley of the roof along one side of the one inclined surface and extending to the peak of the roof and attached to the opposite inclined surface of the roof near the peak thereof, and a valley jack astraddle the valley of the roof and valley support assembly and anchored to the valley support assembly. The roof and valley jacks are spaced apart so as to support a flat board extending therebetween.

20 Claims, 4 Drawing Sheets

ROOF SCAFFOLDING SYSTEM

BACKGROUND OF THE INVENTION

1. Field of the Invention

The present invention generally relates to scaffolding for supporting roofers and roofing materials to enable roofers to apply such materials to the roofs and, more particularly, is concerned with a roof scaffolding system which can readily be assembled on and disassembled from roofs of different sizes and configurations.

2. Description of the Prior Art

Completing construction of a roof on a building requires the use of scaffolding to permit roofers to easily and safely move about the roof and to provide for the temporary storage of roofing materials within convenient reach of the roofers. Various arrangement of scaffolding has been proposed and/or developed over the years to meet these requirements.

Representative examples of different arrangements of scaffolding are disclosed in U.S. Pat. No. 232,556 to Silvius, U.S. Pat. No. 718,602 to Chase, U.S. Pat. No. 859,241 to Nantel, U.S. Pat. No. 1,586,421 to Frush, U.S. Pat. No. 2,426,825 to Geary, U.S. Pat. No. 3,526,296 to Stevens, U.S. Pat. No. 4,785,606 to Burton, U.S. Pat. No. 5,318,148 to Franco et al., U.S. Pat. No. 5,624,006 to Richardson, Jr. and U.S. Pat. No. 6,003,629 to Cloutier et al. The scaffolding arrangements of these patents employ various ones of ladders, planks, platforms, ridge hooks, stepped brackets, telescopable bracket arms, movable carriages on tracks, base and cross brace frames, lateral supports with attachment plates, triangular support braces and the like. However, none of these patents appear to have arrived at a combination of components that will provide a scaffolding arrangement that is sufficiently versatile and easy to use so as to facilitate working on roofs of many different sizes and configurations.

Consequently, a need remains for an innovation in roof scaffolding arrangements that will overcome the shortcomings of the prior art without introducing new ones in their place.

SUMMARY OF THE INVENTION

The present invention provides a roof scaffolding system designed to satisfy the aforementioned need. The roof scaffolding system of the present invention can readily be assembled on and disassembled from roofs of different sizes and configurations and has components that can readily be relocated on such roofs as construction of the roofs progress to completion.

Accordingly, the present invention is directed to a roof jack for a roof scaffolding system, which comprises: (a) a rigid support frame having a pair of lower ends laterally spaced apart from one another and an upper apex located above and between the lower ends; (b) a pair of support blocks each attached to one of the lower ends of the support frame and being adapted to rest on one inclined surface of a roof such that the roof jack is adapted to assume a rest position on the one inclined surface with the support frame thereof spaced above the one inclined surface; and (c) a rigid bar having an elongated main portion and opposite front and rear end portions, the rigid bar at the rear end portion being rigidly connected to the upper apex of the support frame and formed as a hook-shaped element extending upwardly from the main portion such that the main portion of the rigid bar is adapted to support an elongated board and the hook-shaped element of the rigid bar is adapted to retain the board on the roof jack, the rigid bar at the front end portion thereof being formed as a transverse extending front attachment key.

The present invention also is directed to a valley jack for a roof scaffolding system, which comprises: (a) a pair of legs rigidly connected together at respective inner ends of the legs to form an apex and diverging away from one another to respective outer ends of the legs; (b) a pair of support blocks each attached to and extending below one of the legs such that the support blocks are adapted to rest on adjacent inclined surfaces of the roof that form a valley therebetween and support the legs such that the legs are spaced above and extend generally parallel to the adjacent inclined surfaces of the roof and converge upwardly toward one another; (c) a pair of hook-shaped elements each attached on and extending upright from the outer end of one of the legs such that the legs support one or more ends of boards thereon and the hook-shaped elements retain the ends of the boards on the legs; and (d) an attachment rod attached to and extending forwardly from the apex formed by the inner ends of the legs.

The present invention further is directed to a roof scaffolding system, which comprises: (a) at least two of the roof jacks as described above laterally spaced apart from one another; and (b) at least two support assemblies disposed adjacent to and anchoring the respective roof jacks on the roof. Each support assembly includes an elongated support member extending under the support frame and between the support blocks of one of the roof jacks and having a plurality of holes defined at locations spaced longitudinally along the support member such that a selected one of the holes at a time is adapted to receive the front attachment key on the rigid bar of one of the roof jacks for holding the one roof jack at the rest position on the one inclined surface of the roof and astraddle the support member. The support member has an upper end adapted to be disposed adjacent to a peak of the roof. Each support assembly also includes an attachment member mounted to the upper end of the support member and adapted to be secured to an opposite inclined surface of the roof and thereby retain the support member in a stationary position extending upwardly along the one inclined surface of the roof.

The present invention still further is directed to a roof scaffolding system, which comprises: (a) at least one roof jack as described above; (b) at least one support assembly as described above being disposed adjacent to the roof jack; (c) at least one valley jack as described above; and (d) at least one valley support assembly disposed adjacent to the valley jack. The valley support assembly includes a valley support member adapted to rest on and extend upwardly along the valley of the roof between the adjacent inclined surfaces thereof. The valley support member has a plurality of anchor elements spaced apart from one another along and fixed on the valley support member such that a selected one of the anchor elements at a time is adapted to receive an end of the attachment rod of the valley jack for holding the valley jack at the rest position on the adjacent inclined surfaces of the roof and bridging the valley therebetween and at the same elevation on the roof as the roof jack such that an end of the board supported on the roof jack can rest on the valley jack. The valley support assembly also includes an attachment member hingedly attached to an upper end of the valley support member and adapted to reach over the peak of the roof and be attached to the opposite inclined surface of the roof adjacent to the peak and thereby retain the valley support member in a stationary position extending upwardly along the valley of the roof.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
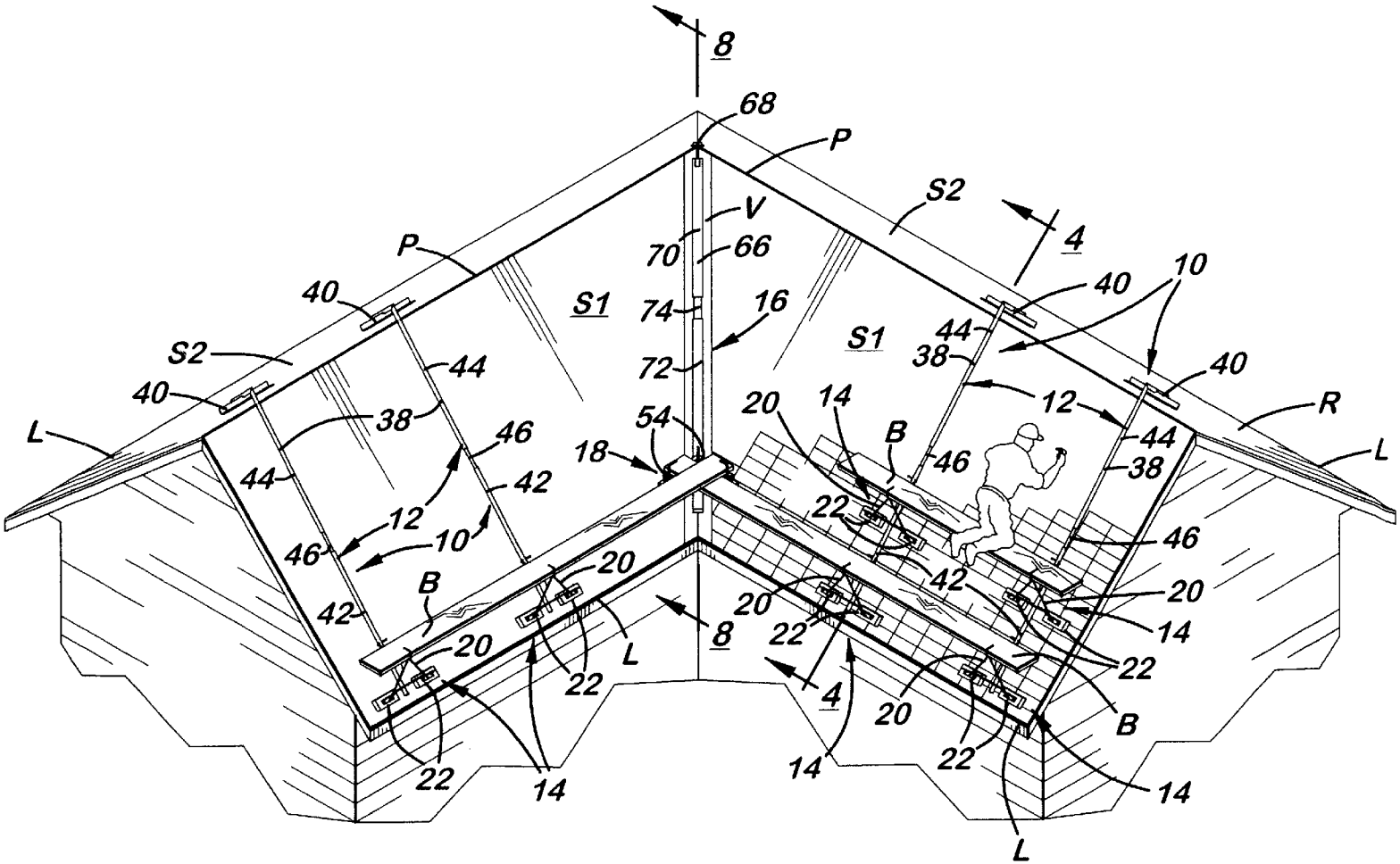
FIG. 1 is a perspective view of one exemplary embodiment of a roof scaffolding system of the present invention shown assembled on a roof of a building.
Figure 2:
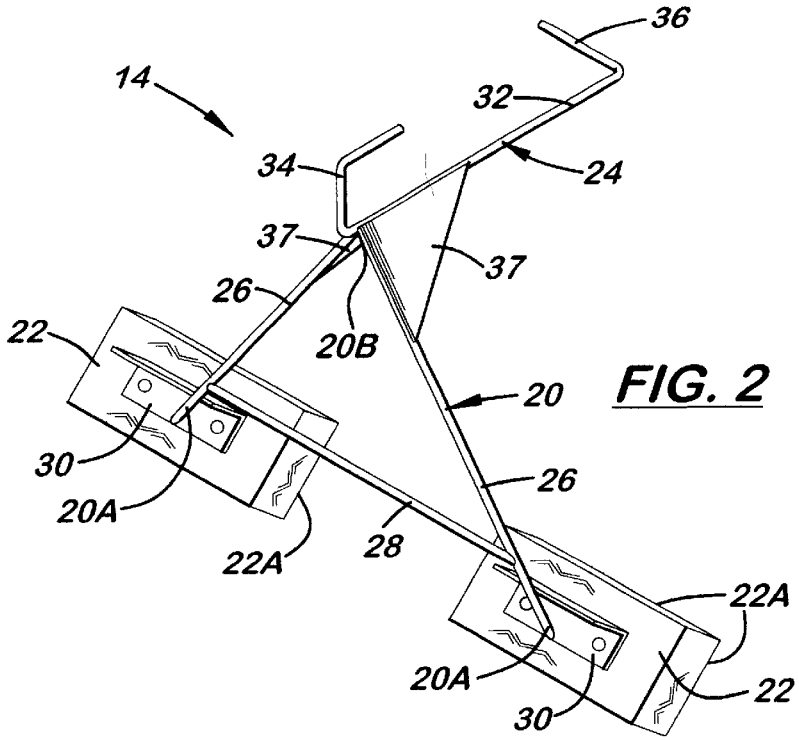
FIG. 2 is a perspective view of a roof jack of the system.
Figure 3:
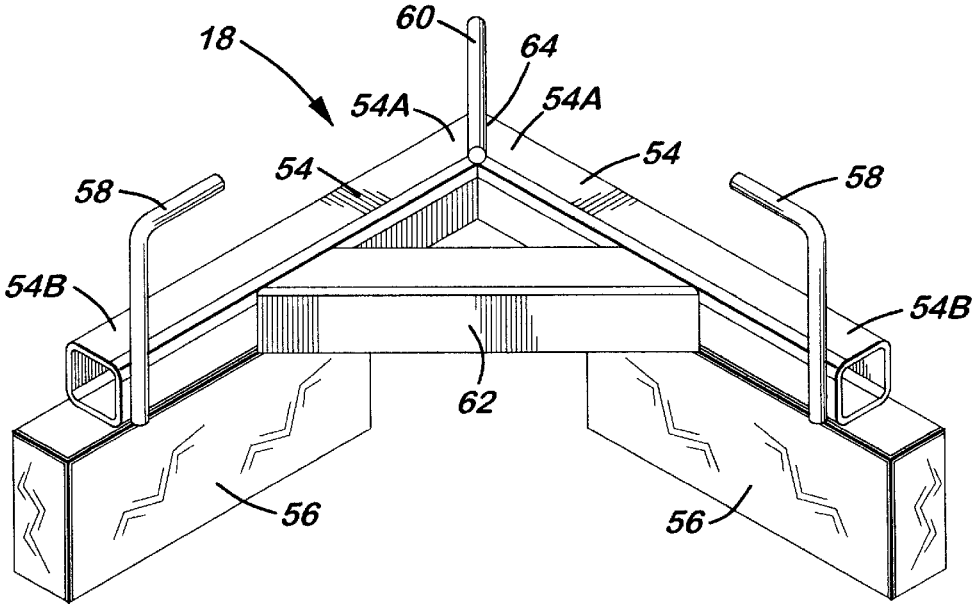
FIG. 3 is a perspective view of a valley jack of the system.

Referring to the drawings and particularly to FIG. 1, there is illustrated an exemplary embodiment of a roof scaffolding system of the present invention, generally designated 10. The roof scaffolding system basically includes one or more roof jack support assemblies 12, one or more roof jacks 14, one or more valley jack support assemblies 16, and one or more valley jacks 18. In the exemplary embodiment shown in FIG. 1, each roof jack support assembly 12 is disposed on one of a pair of adjacent inclined surfaces S1 of a building roof R, extending from a lower edge L to a peak P of the roof R, and is attached to one of a pair of opposite inclined surface S2 of the roof R near the peak P thereof. Each roof jack 14 rests on one inclined surface S1 of the roof R astraddle and connected to one of the roof jack support assemblies 12. Each valley jack support assembly 16 (only one being shown) is disposed on a valley V of the roof R along one side of the inclined surface S1, extending to the peak P of the roof R, and is attached to an opposite inclined surface S2 of the roof R near the peak P thereof. The valley jack 18 is placed astraddle the valley support assembly 16 and valley V of the roof R and is releasably anchored to the valley support assembly 16. Pairs of the roof jacks 14 at the same level on the roof R are spaced apart so as to support together flat boards B extending therebetween. Further, the valley jack 18 is aligned with two pairs of the roof jacks 14 at the same level on the adjacent inclined surfaces S1 of the roof R so as to support one of the opposite ends of the boards B supported by the pairs of roof jacks 14.

Referring now to FIGS. 1, 2 and 4–7, each roof jack 14 of the system 10 includes a rigid support frame 20, a pair of support blocks 22 and a rigid bar 24. The support frame 20 of each roof jack 14 is comprised of a pair of rigid legs 26 and a rigid cross brace 28 fixedly interconnected to one another in a triangular-shaped configuration so as to provide a pair of lower ends 20A laterally spaced apart from one another and an upper apex 20B located above and between the lower ends 20A. Each of the support blocks 22 are secured to one of the lower ends 20A of the support frame 20 via brackets 30 fixed on the lower ends 20A such that the support blocks 22 are spaced apart from and aligned with one another. The support blocks 22 have respective bottom surfaces 22A which lie in a common plane so as to adapt the support blocks 22 and thereby the roof jack 14 to rest on one inclined surface S1 of the roof R such that the support frame 20 of the roof jack 14 spaced above the inclined surface S1. The rigid bar 24 has an elongated substantially straight main portion 32 and opposite rear and front end portions 34, 36. The rear end portion 34 of the rigid bar 24 is rigidly connected to the upper apex 20B of the support frame 20 and reinforced via a pair of triangular-shaped braces 37 extending between and rigidly connected to the rigid bar 24 and the legs 26 of the support frame 20. The rear end portion 34 is provided in the form of an L-shaped or hook-shaped element 34 extending upwardly from the main portion 32 such that the main portion 32 is adapted to support a portion of one elongated board B and the hook-shaped element 34 is adapted to retain the board B on the main portion 32. The front end portion 36 of the rigid bar 24 is provided in the form of a transverse extending front attachment key 36. Thus, two of the roof jacks 14 can support an elongated flat board B, to form a walkway or the like, in a generally horizontal orientation on the main portions 32 where the board B is retained by the upright hook-shaped elements 34.

Figures 4, 5, 6, 7:
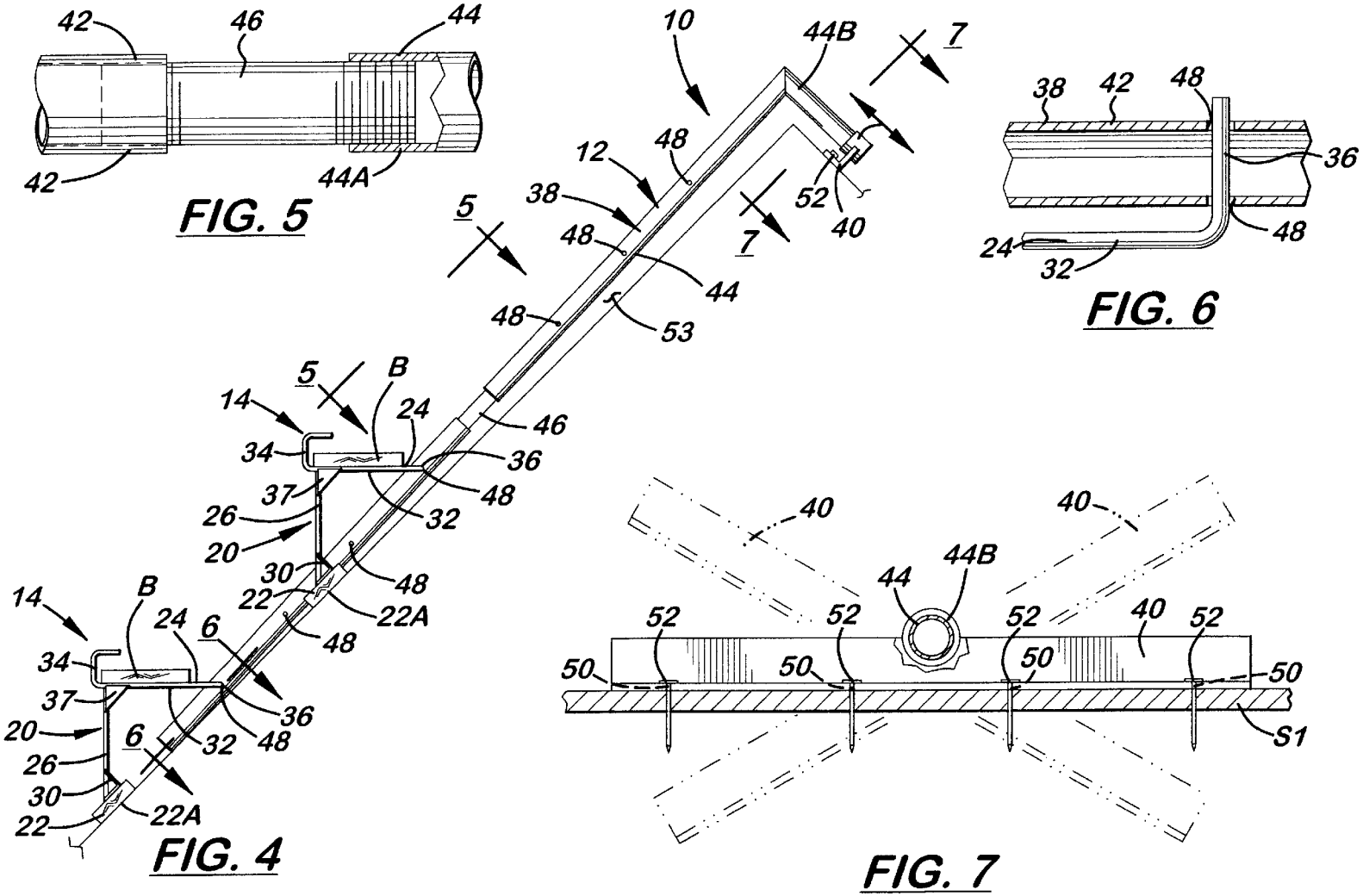
FIG. 4 is an enlarged side elevational view of a pair of the roof jacks and a support assembly of the system as seen along line 4—4 of FIG. 1, showing a support member of the support assembly and the two roof jacks positioned on one inclined surface of the roof and an attachment member of the support assembly attached on an opposite inclined surface of the roof near a peak thereof.
FIG. 5 is an enlarged fragmentary top plan view taken along line 5—5 of FIG. 4, showing a connection provided by a collar between lower and upper pipe sections of the support member of the roof jack support assembly of the system.
FIG. 6 is an enlarged fragmentary longitudinal sectional view of the support member of the roof jack support assembly of the system taken along line 6—6 of FIG. 4, showing the connection of an attachment key of one of the roof jacks to a selected hole in the support member of the support assembly.
FIG. 7 is an enlarged cross-sectional view of the support assembly of the system taken along line 7—7 of FIG. 4, showing in greater detail the attachment member attached on the opposite rear inclined surface of the roof.

Each roof jack support assembly 12 of the system 10 is disposed adjacent to one or more of the roof jacks 14, extending along the inclined surface S1 of the roof R from the lower edge L to the top peak P thereof. Each support assembly 12 includes an elongated roof jack support member 38 and an attachment member 40. The support member 38 of the support assembly 12, which has an elongated pipe-shaped configuration, extends under the support frame 20 and between the support blocks 22 of each of the roof jacks 14 associated with the particular support member 38. The support member 38, preferably although not necessarily, includes a lower pipe section 42, an upper pipe section 44, and means in the form of a collar 46 for detachably interconnecting the lower and upper pipe sections 42, 44 in an end-to-end relationship so as to provide the support member 12. As best seen in FIG. 5, the collar 46 is threaded at opposite ends thereof and thereby adapted to detachably threadably attach to adjacent ones of ends 42A, 44A of the lower and upper pipe sections 42, 44 so as to retain the lower pipe section 42 in a stationary position aligned with the upper pipe section 44 in a stationary position. The collar 46 permits the lower and upper pipe sections 42, 44 to be taken apart so as to facilitate easier handling of the support member 38. At least the lower pipe section 42, and preferably both the lower and upper pipe sections 42, 44, of the support member 38 include a plurality of holes 48 defined therein at locations spaced longitudinally therealong such that, as best seen in FIG. 6, a selected one of the holes 48 at a time is adapted to receive the front attachment key 36 on the rigid bar 24 of one of the roof jacks 14 for holding the one roof jack 14 at a rest position on the one inclined surface S1 of the roof R and astraddle the support member 38. The upper pipe section 44 of the support member 38 also has an upper end 44B adapted to be disposed adjacent to the peak P of the roof R. More particularly, the upper end 44B of the upper pipe section 44 of the support member 38 is formed at as angle, such as a ninety-degree angle, relative to the relative straight remainder of the support member 38 and is adapted to reach over the peak P of the roof R and extend for a short distance down the opposite inclined surface S2 of the roof R.

The attachment member 40 of the roof jack support assembly 12 extends transversely and is pivotally mounted to the upper end 44B of the upper pipe section 44 of the roof jack support member 38. Also, the attachment member 40 is adapted to be secured to the opposite inclined surface S2 of the roof R and thereby retain the support member 38 in a stationary position extending upwardly along the one inclined surface S1 of the roof R. As best seen in FIG. 7, the attachment member 40 has at least one and preferably a plurality of holes 50 for receiving fasteners 52 to secure the attachment member 38 onto the opposite inclined surface S2 of the roof R and thereby retain the support member 38 in the stationary position extending upwardly along the one inclined surface S1 of the roof R. As best seen in FIG. 4, the attachment member 40 preferably is attached to the opposite inclined surface S2 of the roof R at such distance from the peak P that is preselected to cause the support member 38 to be elevated off the one inclined surface S1 so as to provide sufficient space 53 to allow installation of roofing materials under the support member 38. The pivotal mounting of the attachment member 40 to the support member 38 permits the attachment member 40 to be pivoted to any angular position that will match the particular angle of the roof peak P relative to horizontal and then secured to the opposite roof surface at such angular position.

Figures 8, 9, 10, 11:
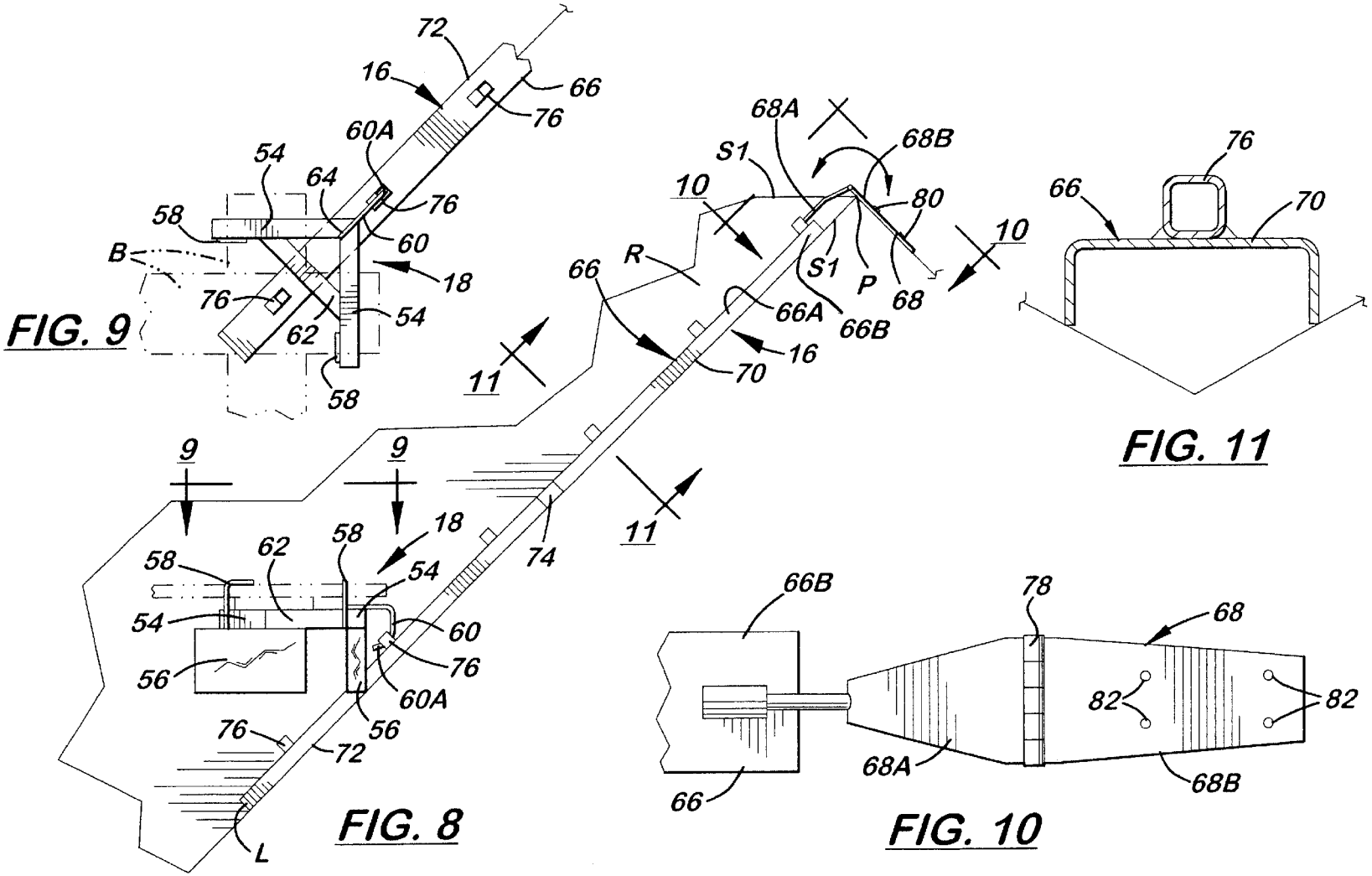
FIG. 8 is an enlarged side elevational view of the valley jack and a valley support assembly of the system as seen along line 8—8 of FIG. 1, showing a valley support member of the valley support assembly and the valley jacks positioned on a valley between adjacent inclined surfaces of the roof and an attachment member of the valley support assembly attached on the opposite inclined surface of the roof near the peak thereof.
FIG. 9 is a top plan view of the valley jack of the system as seen along line 9—9 of FIG. 8.
FIG. 10 is an enlarged top plan view as seen along line 10—10 of FIG. 8, showing the attachment member attached to an upper end of the valley support member of the valley jack support assembly of the system.
FIG. 11 is an enlarged cross-sectional view taken along line 11—11 of FIG. 8, showing an anchor element on the valley support member of the valley jack support assembly of the system.

Referring now to FIGS. 1, 3 and 8–11, the valley jack 18 of the system 10 includes a pair of legs 54, a pair of support blocks 56, a pair of hook-shaped elements 58 and an attachment rod 60. The legs 54, being for example in the form of rigid tubes rectangular in cross-section, are rigidly interconnected together by a cross brace 62 and directly connected together at respective inner ends 54A of the legs 54 to form an apex 64. The legs 54 diverge away from one another to respective outer ends 54B thereof such that the pair of legs 54 together have a V-shaped configuration. The support blocks 56 are each attached to and extend below and along one of the legs 54 such that the support blocks 56 are adapted to rest on the adjacent inclined surfaces S1 of the roof R that form the valley V therebetween and support the legs 54 such that the legs 54 are spaced above and extend generally parallel to the adjacent inclined surfaces S1 of the roof R and converge upwardly toward one another. The hook-shaped elements 58 are rigidly attached on and extend upright from the outer ends 54B of the respective legs 54. As best seen in FIGS. 8 and 9, the legs 54 support one ends E of the boards B thereon and the hook-shaped elements 58 retain the one ends E of the boards B on the legs 54. The attachment rod 60 is rigidly attached to and extends forwardly from the apex 64 formed by the inner ends 54A of the legs 54. The attachment rod 60 preferably has a generally J-shaped configuration and a transverse extending terminal end 60A.

The valley support assembly 16 of the system 10 is disposed adjacent to the valley jack 18 and extends along the valley V of the roof R. The valley support assembly 16 includes an elongated valley support member 66 and an attachment member 68. The valley support member 66 can be in the form of a pair of upper and lower elongated bar sections 70, 72 detachably coupled together by a suitable coupler sleeve 74 and adapted to rest on and extend upwardly along the valley V of the roof R between the adjacent inclined surfaces S1 thereof. The coupler sleeve 74 permits the lower and upper bar sections 70, 72 to be taken apart so as to facilitate easier handling of the valley support member 66. The valley support member 66 has a plurality of anchor elements 76 in the form of rigid loops 76 spaced apart from one another along and fixed on an upper side 66A of the valley support member 66. A selected one of the anchor elements 76 at a time is adapted to receive the terminal end 60A of the attachment rod 60 of the valley jack 18 for holding the valley jack 18 at the rest position on the adjacent inclined surfaces S1 of the roof R, bridging the valley V therebetween, and at the same elevation on the roof R as two of the pairs of roof jack 14 such that the one ends E of the boards B supported on the two pairs of roof jacks 14 can rest on the legs 54 of the valley jack 54.

The attachment member 68 of the valley support assembly 16 has parts 68A, 68B hingedly connected at 78 to one another with the one part 68A, in turn, rigidly attached to an upper end 66B of the valley support member 66. The attachment member 68 is adapted to reach over the peak P of the roof R and be attached via fasteners 80 inserted through holes 82 in its other part 68B to the opposite inclined surface S2 of the roof R adjacent to the peak P and thereby retain the valley support member 66 in a stationary position extending upwardly along the valley V of the roof R. The valley support member 66 holds the valley jack 18 at the rest position on the adjacent roof surfaces S1, bridging the valley V therebetween, and at the same elevation on the roof R as the roof jacks 14 such that one ends E of the flat walkway-forming boards B supported on the roof jacks 14 can rest on the valley jack 18.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A roof scaffolding system, comprising:

(a) at least two roof jacks laterally spaced apart from one another, each of said roof jacks including (i) a rigid support frame having a pair of lower ends laterally spaced apart from one another and an upper apex located above and between said lower ends, (ii) a pair of support blocks each attached to one of said lower ends of said support frame and being adapted to rest on one inclined surface of a roof such that said laterally spaced apart roof jacks are adapted to assume rest positions on the one inclined surface with said support frames thereof spaced above the one inclined surface, and (iii) a rigid bar having an elongated main portion and opposite front and rear end portions, said rigid bar at said rear end portion being rigidly connected to said upper apex of said support frame and formed as a hook-shaped element extending upwardly from said main portion such that said main portions of said rigid bars of said laterally spaced apart roof jacks are adapted to support an elongated board extending horizontally between said roof jacks and said hook-shaped elements of said rigid bars of said laterally spaced apart roof jacks are adapted to retain the board on said roof jacks, said rigid bar at said front end portion being formed as a transverse extending front attachment key; and (b) at least two support assemblies, each of said support assemblies being disposed adjacent to one of said roof jacks and including (i) an elongated support member extending under said support frame and between said support blocks of said one of said roof jacks and having a plurality of holes defined at locations spaced longitudinally along said support member such that a selected one of said holes at a time is adapted to receive said front attachment key on said rigid bar of said one of said roof jacks for holding said one roof jack at the rest position on the one inclined surface of the roof and astraddle said support member, said support member further having an upper end adapted to be disposed adjacent to a peak of the roof, and (ii) an attachment member mounted to said upper end of said support member and adapted to be secured to an opposite inclined surface of the roof and thereby retain said support member in a stationary position extending upwardly along the one inclined surface of the roof.

2. The system of claim 1 wherein said support frame of each of said roof jacks has a substantially triangular-shaped configuration.

3. The system of claim 1 wherein said upper end of said support member is formed at an angle to the remainder of said support member and adapted to reach over the peak of the roof and extend for a short distance down the opposite inclined surface of the roof.

4. The system of claim 3 wherein said attachment member is transversely disposed across and mounted to said upper end of said support member and has at least one hole for receiving a fastener therethrough to secure said attachment member to the opposite inclined surface of the roof and thereby retain said support member in the stationary position extending upwardly along the one inclined roof surface.

5. The system of claim 1 wherein said support member includes:

a lower pipe section having said holes for receiving said front attachment key of one of said roof jacks;

an upper pipe section having said upper end of said support member; and means for detachably interconnecting said lower and upper pipe sections to one another so as to provide said support member.

6. The system of claim 5 wherein said attachment member is pivotally mounted to said upper end of said upper pipe section and has a plurality of holes for receiving fasteners to secure said attachment member onto the opposite inclined surface of the roof.

7. The system of claim 5 wherein said means for detachably interconnecting said lower and upper pipe sections is a collar threaded at opposite ends thereof and thereby adapted to detachably threadably attach to adjacent ones of ends of said upper and lower pipe sections so as to retain lower pipe section in a stationary position aligned with said upper pipe section in a stationary position.

8. A roof scaffolding system, comprising:

(a) at least one roof jack including (i) a rigid support frame having a pair of lower ends laterally spaced apart from one another and an upper apex located above and between said lower ends, (ii) a pair of support blocks each attached to one of said lower ends of said support frame and being adapted to rest on one inclined surface of a roof such that said support frame is spaced above the one inclined surface, and (iii) a rigid bar having an elongated main portion and opposite front and rear end portions, said rigid bar at said rear end portion being rigidly connected to said upper apex of said support frame and formed as a hook-shaped element extending upwardly from said main portion such that said main portion is adapted to support a portion of an elongated board and said hook-shaped element is adapted to retain the board on said main portion, said rigid bar at said front end portion being formed as a transverse extending front attachment key;

(b) at least one support assembly disposed adjacent to said roof jack and including (i) an elongated support member extending under said support frame and between said support blocks of said roof jack and having a plurality of holes defined at locations spaced longitudinally along said support member such that a selected one of said holes at a time is adapted to receive said front attachment key on said rigid bar of said roof jack for holding said roof jack at the rest position on the one inclined surface of the roof and astraddle said support member, said support member further having an upper end adapted to be disposed adjacent to a peak of the roof, and (ii) an attachment member mounted to said upper end of said support member and adapted to be secured to an opposite inclined surface of the roof and thereby retain said support member in a stationary position extending upwardly along the one inclined roof surface;

(c) at least one valley jack including (i) a pair of legs rigidly connected together at respective inner ends of said legs to form an apex and diverging away from one another to respective outer ends of said legs, (ii) a pair of support blocks each attached to and extending below one of said legs such that said support blocks are adapted to rest on adjacent inclined surfaces of the roof that form a valley therebetween and support said legs such that said legs are spaced above and extend generally parallel to the adjacent inclined surfaces of the roof and converge upwardly toward one another, (iii) a pair of hook-shaped elements each attached on and extending upright from said outer end of one of said legs such that said legs support one or more ends of boards thereon and said hook-shaped elements retain the ends of the boards on said legs, and (iv) an attachment rod attached to and extending forwardly from said apex formed by said inner ends of said legs; and (d) at least one valley support assembly disposed adjacent to said valley jack and including (i) a valley support member adapted to rest on and extend upwardly along the valley of the roof between the adjacent inclined surfaces thereof and having a plurality of anchor elements spaced apart from one another along and fixed on said valley support member such that a selected one of said anchor elements at a time is adapted to receive an end of said attachment rod of said valley jack for holding said valley jack at the rest position on the adjacent inclined surfaces of the roof and bridging the valley therebetween and at the same elevation on the roof as said roof jack such that an end of the board supported on said roof jack can rest on said valley jack, and (ii) an attachment member hingedly attached to and an upper end of said valley support member and adapted to reach over the peak of the roof and be attached to the opposite inclined surface of the roof adjacent to the peak and thereby retain said valley support member in a stationary position extending upwardly along the valley of the roof.

9. The system of claim 8 wherein said support frame of each of said roof jacks has a substantially triangular-shaped configuration.

10. The system of claim 8 wherein said upper end of said support member is formed at an angle to the remainder of said support member and adapted to reach over the peak of the roof and extend for a short distance down the opposite inclined surface of the roof.

11. The system of claim 10 wherein said attachment member is transversely disposed across and mounted to said upper end of said support member and has at least one hole for receiving a fastener therethrough to secure said attachment member to the opposite inclined surface of the roof and thereby retain said support member in the stationary position extending upwardly along the one inclined roof surface.

12. The system of claim 8 wherein said support member includes:

a lower pipe section having said holes for receiving said front attachment key of one of said roof jacks;

an upper pipe section having said upper end of said support member; and means for detachably interconnecting said lower and upper pipe sections to one another so as to provide said support member.

13. The system of claim 12 wherein said attachment member is pivotally mounted to said upper end of said upper pipe section and has a plurality of holes for receiving fasteners to secure said attachment member onto the opposite inclined surface of the roof.

14. The system of claim 13 wherein said means for detachably interconnecting said lower and upper pipe sections is a collar threaded at opposite ends thereof and thereby adapted to detachably threadably attach to adjacent ones of ends of said upper and lower pipe sections so as to retain lower pipe section in a stationary position aligned with said upper pipe section in a stationary position.

15. The system of claim 8 wherein said legs of said valley jack are rigidly connected together in a V-shaped configuration.

16. The system of claim 8 wherein said attachment rod of said valley jack has a J-shaped configuration.

17. The system of claim 8 wherein said anchor elements on said valley support member are loops spaced apart from one another along and fixed on an upper side of said valley support member.

18. A roof jack for a roof scaffolding system, said roof jack comprising:

(a) a rigid support frame having a pair of lower ends laterally spaced apart from one another and an upper apex located above and between said lower ends;

(b) a pair of support blocks each attached to one of said lower ends of said support frame and being adapted to rest on one inclined surface of a roof such that said roof jack is adapted to assume a rest position on the one inclined surface with said support frame thereof spaced above the one inclined surface; and (c) a rigid bar having an elongated main portion and opposite front and rear end portions, said rigid bar at said rear end portion being rigidly connected to said upper apex of said support frame and formed as a hook-shaped element extending upwardly from said main portion such that said main portion of said rigid bar is adapted to support an elongated board and said hook-shaped element of said rigid bar is adapted to retain the board on said roof jack, said rigid bar at said front end portion being formed as a transverse extending front attachment key.

19. The roof jack of claim 18 wherein said support frame has a substantially triangular-shaped configuration.

20. A valley jack for a roof scaffolding system, said valley jack comprising:

(a) a pair of legs rigidly connected together at respective inner ends of said legs to form an apex and diverging away from one another to respective outer ends of said legs;

(b) a pair of support blocks each attached to and extending below one of said legs such that said support blocks are adapted to rest on adjacent inclined surfaces of the roof that form a valley therebetween and support said legs such that said legs are spaced above and extend generally parallel to the adjacent inclined surfaces of the roof and converge upwardly toward one another;

(c) a pair of hook-shaped elements each attached on and extending upright from said outer end of one of said legs such that said legs support one or more ends of boards thereon and said hook-shaped elements retain the ends of the boards on said legs; and (d) an attachment rod attached to and extending forwardly from said apex formed by said inner ends of said legs.

* * * * *